US007413362B2

(12) United States Patent
Bandou

(10) Patent No.: US 7,413,362 B2
(45) Date of Patent: Aug. 19, 2008

(54) PAPER TRAY FOR PRINTER

(75) Inventor: Takayoshi Bandou, Anan (JP)

(73) Assignee: Funai Electric Co., Ltd., Daito-shi (JP)

( * ) Notice: Subject to any disclaimer, the term of this patent is extended or adjusted under 35 U.S.C. 154(b) by 310 days.

(21) Appl. No.: 11/372,061

(22) Filed: Mar. 10, 2006

(65) Prior Publication Data

US 2006/0210346 A1 Sep. 21, 2006

(30) Foreign Application Priority Data

Mar. 17, 2005 (JP) ..... 2005-77469

(51) Int. Cl.
*B41J 29/02* (2006.01)
*E05D 7/10* (2006.01)

(52) U.S. Cl. ..... 400/693; 16/254; 16/259; 16/260

(58) Field of Classification Search ..... 16/225, 16/254, 257, 259, 260; 400/622, 693
See application file for complete search history.

(56) References Cited

U.S. PATENT DOCUMENTS 6,074,030 A * 6/2000 Prunty et al. ..... 312/404
6,830,401 B1 * 12/2004 Hwang et al. ..... 400/693

FOREIGN PATENT DOCUMENTS

JP 11-177257 A 7/1999
JP 2000-13045 A 1/2000

* cited by examiner

*Primary Examiner*—Daniel J. Colilla
*Assistant Examiner*—M. L. Ferguson-Samreth
(74) *Attorney, Agent, or Firm*—Crowell & Moring LLP

(57) ABSTRACT

A paper tray for a printer includes a paper support plate for supporting paper sheets stacked thereon and a support frame formed on the printer body adjacent the paper inlet. The paper support plate has a C-shaped hook having a base portion and upper and lower arms. The support frame has a protruding shaft and an upwardly inclined housing wall. The paper support plate is detachably hinged to the support frame with the C-shaped hook engaged with the protruding shaft so as to be rotated between a vertical position and a horizontal position. The housing wall extends forward beyond the protruding shaft and has a horizontal surface serving as a contact surface at the top of the extending portion. The C-shaped hook has a rib at the base portion. When the paper support plate is rotated to the horizontal position, the rotation is limited by the under surface of the rib coming in contact with the top surface of the extending portion. A reaction force acting on the C-shaped hook with a fulcrum on the contact portion between the top surface of the extending portion and the under surface of the rib is directed substantially vertically downward to the base portion of the hook. Accordingly, a force to be applied on the lower arm of the hook can be reduced, so that the hinge portion can be protected from breakage.

4 Claims, 5 Drawing Sheets

PAPER TRAY FOR PRINTER

BACKGROUND OF THE INVENTION

1. Field of the Invention

The present invention relates to a paper tray for a printer and more particularly to a paper tray for a printer that has a paper support plate detachably hinged to the printer body adjacent its paper inlet or outlet.

2. Description of the Related Art

Printers are known in which a plate for supporting paper sheets to be fed through the paper inlet in the printer body or supporting paper sheets ejected through the paper outlet in the printer body is pivotally hinged to the printer body adjacent the paper inlet or outlet. By upwardly rotating the paper support plate into a substantially vertical position in which the plate is substantially parallel to the face of the printer body, the printer can be made compact so as to be convenient to store. Downwardly rotating the paper support plate into a substantially horizontal position allows paper sheets to be horizontally stacked on the upper surface of the plate.

Generally, a portion hinged to another member has to bear a heavy load. Therefore, in order to prevent breakage of a hinge portion, various techniques have been proposed. For example, a structure is known in which a hinge portion of an openable and closable door for covering an operation panel at the front side of a VTR is formed with a protrusion to come in contact with a contact surface on the VTR body when the door is opened, so that a load applied when the door is opened is distributed between a bearing and the contact surface in order to prevent the breakage (see, for example, Japanese laid-open patent publication Hei 11-177257). There is also known a structure in which a synthetic resin bearing having a slit is provided at a main unit and a pivot pin is provided at an openable and closable door so that, when an excessive force is applied to the pivot pin, the slit of the bearing allows the bearing itself to change the shape so as to let the pivot pin off the bearing (see, for example, Japanese laid-open patent publication 2000-13045).

In a printer having a paper support plate pivotally hinged to the printer body adjacent its paper inlet or outlet, it is desirable that the paper support plate can be detached from the printer body when a paper jam in the paper inlet or outlet or other trouble occurs. Thus, a structure as described below is often used at the hinge portion.

FIG. 5 shows main parts of the structure. On a printer body adjacent the paper inlet, there is provided a cylindrical protruding shaft 55 having 45-degree inclined flat portions 55*a* at part of the cylindrical surface. On one end of a paper support plate 57, there is provided a C-shaped hook 56 that has upper and lower arms 56*b* and 56*c* to be open toward the outside of the paper support plate. The opening 56*d* of the C-shaped hook 56 has a width substantially equal to the distance between the flat portions 55*a* of the protruding shaft 55. By tilting the paper support plate 57 and moving it diagonally downward so that the protruding shaft 55 is inserted into the C-shaped hook 56, the C-shaped hook 56 is rotatably engaged with the protruding shaft 55. To detach the paper support plate 57 from the printer body, the above procedure is reversed. More particularly, the paper support plate 57 is rotated into the tilted position before moved diagonally upward so that the protruding shaft 55 gets out of the opening 56*d* of the C-shaped hook 56.

The above described hinge structure is desirable as a structure provided at the paper inlet or outlet of a printer for supporting a paper support plate, in that it allows the paper support plate 57 to be easily attached to or detached from the printer body and has the paper support plate 57 rotatable with the C-shaped hook 56 engaged with the protruding shaft 55. However, the structure has a drawback that the C-shaped hook 56 is prone to breakage especially at the lower arm 56*c*. As a result of various studies, the inventors of the present invention found the following cause of the breakage of the lower arm 56*c* of the C-shaped hook.

In order to keep the paper support plate 57 in the horizontal position so that paper sheets can be stacked on the upper surface of the plate, the angle of the downward rotation (rotation in a direction A clockwise in FIG. 5) of the paper support plate 57 has to be limited to specified degree. The conventional structure is designed to limit the downward rotation of the paper support plate 57 by the edge 57*a* of the paper support plate 57 coming in contact with a housing wall 53*a* of the printer body. However, it has been found that, when the paper support plate 57 is in the horizontal position, the conventional structure causes a large moment to be produced in a direction clockwise in FIG. 5 with the fulcrum V on the contact portion between the edge 57*a* of the paper support plate 57 and the housing wall 53*a* of the printer body, and thereby causes a large reaction force R from the protruding shaft 55 to act on the lower arm 56*c* of the C-shaped hook 56. The reaction force R has a direct action on the lower arm 56*c*, which may cause downward buckling of the lower arm and thus may result in a crack or breakage S at the base of the lower arm 56*c*.

It is possible to form the entire C-shaped hook 56 thicker in order to prevent a breakage of the lower arm 56*c*. However, it requires increased amount of resin material. Moreover, even though it can prevent a breakage of the lower arm 56*c*, there is a possibility that an excessive force is applied to another portion, e.g., a portion of the C-shaped hook 56 that is joined to the paper support plate 57, and as a result, the portion is easy to break, because there is no difference in magnitude and direction of the moment produced with the fulcrum V on the contact portion between the edge 57*a* of the paper support plate 57 and the housing wall 53*a* of the printer body.

SUMMARY OF THE INVENTION

An object of the present invention is to provide a paper tray for a printer that has a paper support plate detachably hinged to the printer body and allows a force applied to a lower arm of a C-shaped hook to be reduced so as to protect the hinge portion from breakage, while being simple in structure.

According to an aspect of the present invention, a paper tray for a printer comprises: a paper support plate that is adapted to support either a sheet of paper to be fed through a paper inlet formed in a printer body or a sheet of paper ejected through a paper outlet formed in the printer body and that has a C-shaped hook having upper and lower arms to be open at one side of the hook; and a support frame that is formed on a housing of the printer body adjacent the paper inlet or the paper outlet and that has a protruding shaft and a housing wall.

The paper support plate is hinged to the support frame with the C-shaped hook engaged with the protruding shaft on the support frame so that the paper support plate can be rotated between a vertical position where the paper support plate is folded to be substantially parallel to a face of the printer body and a horizontal position where the paper support plate projects in a direction substantially perpendicular to the face of the printer body.

The housing wall has an extending portion extending forward beyond the protruding shaft, the extending portion having a top surface serving as a contact surface to contact the C-shaped hook, and the C-shaped hook has a contact surface to face the top surface of the extending portion at a position opposite to the open side, so that rotation of the paper support plate to the horizontal position is limited by the contact surface of the C-shaped hook coming in contact with the top surface of the extending portion.

With the above configuration, the paper tray for a printer that has the paper support plate detachably hinged to the printer body allows a force applied to the lower arm of the C-shaped hook to be reduced so as to protect the hinge portion from breakage, while being simple in structure.

Preferably, the C-shaped hook has a rib projecting from the position opposite to the open side, and the contact surface to face the top surface of the extending portion is provided on an under surface of the rib.

Preferably, the top surface of the extending portion is a substantially horizontal surface, and the C-shaped hook has a rib projecting sideward and having an under surface serving as the contact surface to face the top surface of the extending portion, so that the under surface of the rib coming in contact with the top surface of the extending portion limits the rotation of the paper support plate to the horizontal position and causes a reaction force acting, by gravity of the paper support plate, on the C-shaped hook with a fulcrum on the contact portion between the top surface of the extending portion and the under surface of the rib to be directed to a base portion of the C-shaped hook.

In one embodiment, the paper support plate is an assembly having a plurality of nested plates that can be extended and retracted.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

DESCRIPTION OF THE PREFERRED EMBODIMENTS

Referring now to FIGS. 1 to 4, one embodiment of the present invention is described. It is to be noted that the following description of preferred embodiment of the present invention has been presented for purposes of illustration and description, and is not intended to be exhaustive or to limit the present invention to the precise form disclosed.

Figure 1:
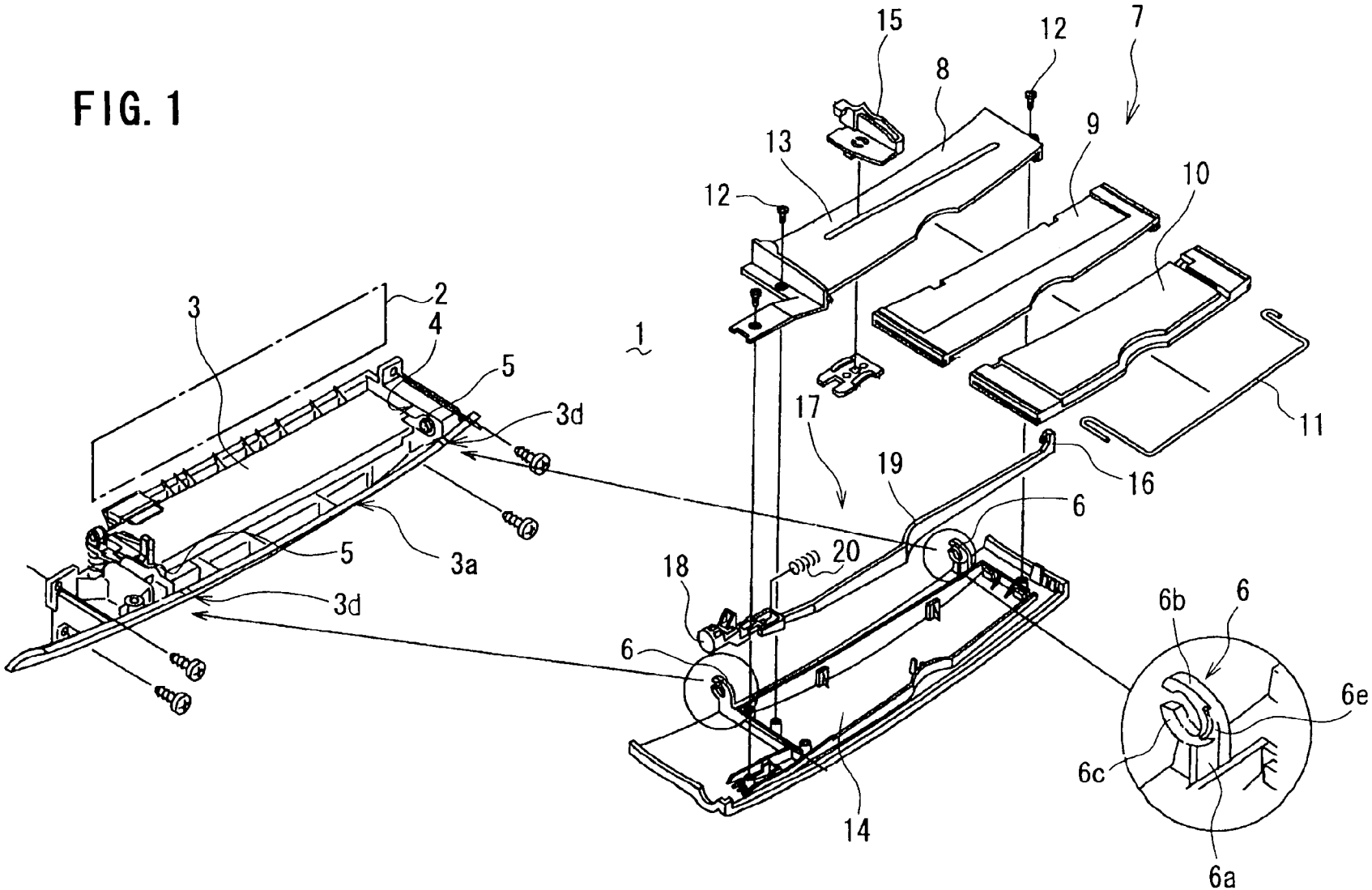
FIG. 1 is an exploded perspective view of a printer paper tray according to one embodiment of the present invention.
Figure 2:
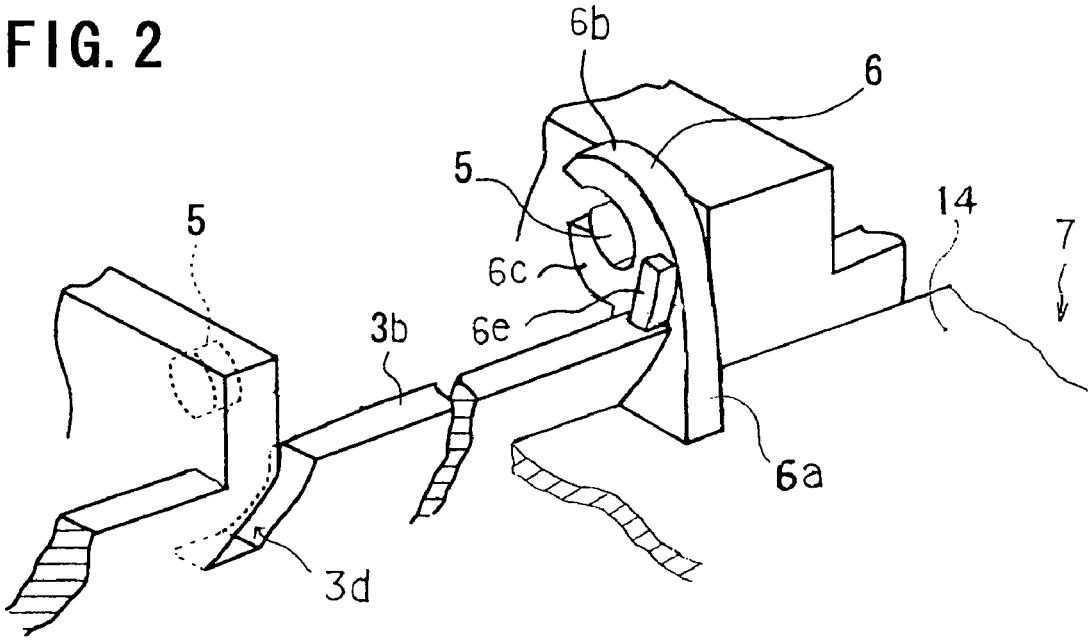
FIG. 2 is a perspective view of a hinge portion of the paper tray.

As shown in FIG. 1, a paper tray 1 according to this embodiment comprises: a support frame 3 that is formed integrally with a housing of a printer body to project from the housing below a paper inlet 2 in the printer body and that has side walls 4 each formed with a shaft 5 protruding therefrom; and a paper support plate 7 detachably hinged to the support frame 3 with C-shaped hooks 6 engaged with the respective protruding shafts 5 on the side walls 4 of the support frame 3. As shown in FIG. 3, each of the protruding shafts 5 has approximately 45-degree inclined flat portions 5*a* formed by partly cutting out the cylindrical surface of the shaft. Each of the C-shaped hooks 6 comprises a base portion 6*a* provided on one end of the paper support plate 7 and upper and lower arms 6*b* and 6*c* extending from the base portion 6*a* so as to have an opening 6*d* that is open toward the outside of the paper support plate 7 to receive the protruding shaft 5. The opening 6*d* is formed to have a width substantially equal to the distance between the flat portions 5*a* of the protruding shaft 5. Accordingly, by tilting the paper support plate 7 and moving it diagonally downward so that the protruding shafts 5 are inserted into the respective C-shaped hooks 6, the C-shaped hooks 6 are rotatably engaged with the protruding shafts 5.

Provided at the front of the support frame 3 is an upwardly inclined housing wall 3*a*, whose front end extends forward beyond the protruding shafts 5. The forward extending portion 3*b* of the housing wall 3*a* has a horizontal surface 3*c* serving as a contact surface at the top thereof (hereinafter referred to as a top surface 3*c*). Formed on the base portion 6*a* of the C-shaped hook 6 is a rib 6*e* projecting sideward. When the paper support plate 7 is rotated from the vertical position to the horizontal position (in the direction indicated by an arrow A in FIG. 3A), the under surface 6*f* (contact surface) of the rib 6*e* comes in contact with the top surface 3*c* of the extending portion 3*b* so as to limit the rotation of the paper support plate 7. Formed in the extending portion 3*b* adjacent each of the protruding shafts 5 is a slit 3*d*, which receives the base portion 6*a* of the C-shaped hook 6 when the paper support plate 7 is rotated from the vertical position to the horizontal position (see FIG. 2). Preferable extension length of the extending portion 3*b* at the front end of the housing wall is later described in detail.

An edge 14*a* of the paper support plate 7 contacting the inclined housing wall 3*a* also limits the rotation of the paper support plate 7 from the vertical position to the horizontal position.

The configuration of the paper support plate 7 is now described. Referring again to FIG. 1, the paper support plate 7 in this embodiment is an assembly comprising a support plate 8 at the base, two nested plates 9 and 10 that can be extended from and retracted into the support plate 8 in order, and a wire 11 that can be extended from and retracted into the nested plate 10 at the leading end. The paper support plate 7 can be shortened when the wire 11 and the nested plates 9 and 10 are retracted within the support plate 8. By upward rotating the shortened paper support plate 7 into the vertical position substantially parallel to the face of the housing of the printer body, the printer can be compact for storage. In use, by extending forward the wire 11 and the nested plates 9 and 10 from the support plate 8, the paper support plate 7 can have substantially increased surface area for supporting paper sheets, so that even a paper sheet large in size can be placed on the plate 7 without trouble.

The support plate 8 includes upper and lower frame members 13 and 14 secured to each other by screws 12. The upper frame member 13 has an edge guide 15 slidable from side to side for positioning a paper sheet. The lower frame member 14 has the C-shaped hooks 6 formed integrally with an end thereof. Further, provided within the support plate 8 is a lock unit 17 to be used in the position for storage. The lock unit 17 has a hook 16 at the tip thereof, which is engaged with an appropriate portion of the printer body when the paper support plate 7 is in the vertical position through the upward rotation. The lock unit 17 includes a side-to-side movable bar 19 having the hook 16 at one end and a button 18 at the other end, and a spring 20 always biasing the bar 19 in the direction of engagement of the hook 16.

Figure 3A:
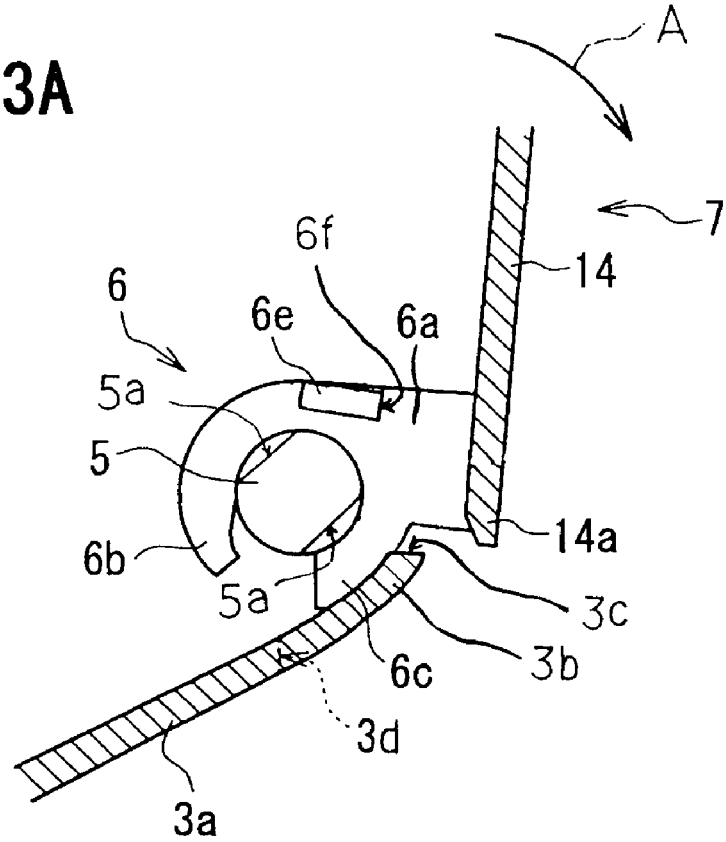
FIGS. 3A and 3B are sectional side views of the hinge portion of the paper tray, showing the position where the paper tray is folded up and the position where the paper tray is open, respectively.
Figure 3B:
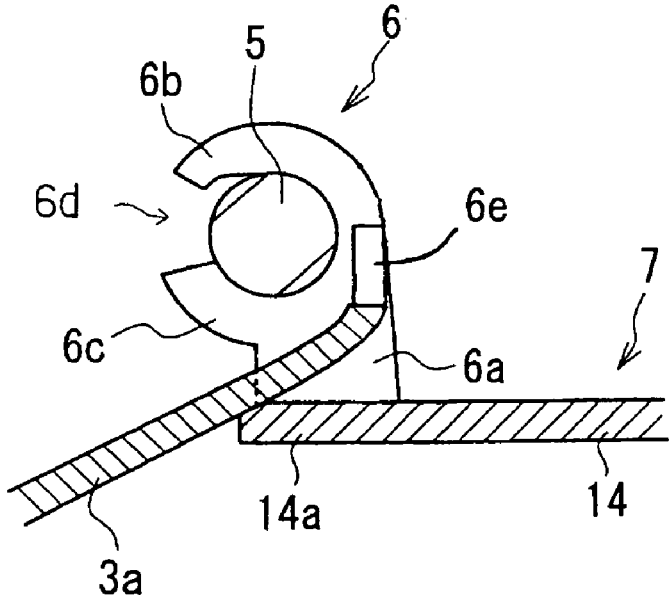

For using the paper tray 1 according to this embodiment that has the above described configuration, the paper support plate 7 is rotated on the protruding shafts 5 in the following steps. A user first disengages the lock unit 17 of the paper support plate 7 in the folded position or substantially vertical position (as shown in FIG. 3A), and then rotates the paper support plate 7 into the substantially horizontal position (as shown in FIG. 3B). The rotation of the paper support plate 7 is limited both by the under surface 6*f* of the rib 6*e* on the C-shaped hook 6 coming in contact with the top surface 3*c* of the forward extending portion 3*b* of the housing wall and by the edge 14*a* of the paper support plate 7 coming in contact with the inclined surface of the housing wall 3*a*. In other words, an impact force at the end of rotation of the paper support plate 7 from the vertical position to the horizontal position is distributed between the above two portions so as to prevent a breakage of a portion (such as the lower arm 6*c* or the rib 6*e* on the C-shaped hook 6) due to concentration of the impact force. This feature is effective especially where a relatively heavy paper support plate is used like the paper support plate 7 in this embodiment that is a relatively heavy assembly comprising the support plate 8, the two nested plates 9 and 10, and the wire 11.

The forward extending portion 3*b* of the housing wall can be made slightly longer than that shown in FIG. 3 so that, when the paper support plate 7 is rotated to the horizontal position, the under surface 6*f* of the rib 6*e* comes in contact with the top surface 3*c* of the forward extending portion 3*b* of the housing wall prior to the edge 14*a* of the paper support plate 7 coming in contact with the inclined surface of the housing wall 3*a*. This configuration causes more of the impact force at the end of the rotation to be applied to the contact portion between the under surface 6*f* of the rib and the top surface 3*c* of the forward extending portion 3*b*.

Figure 4A:
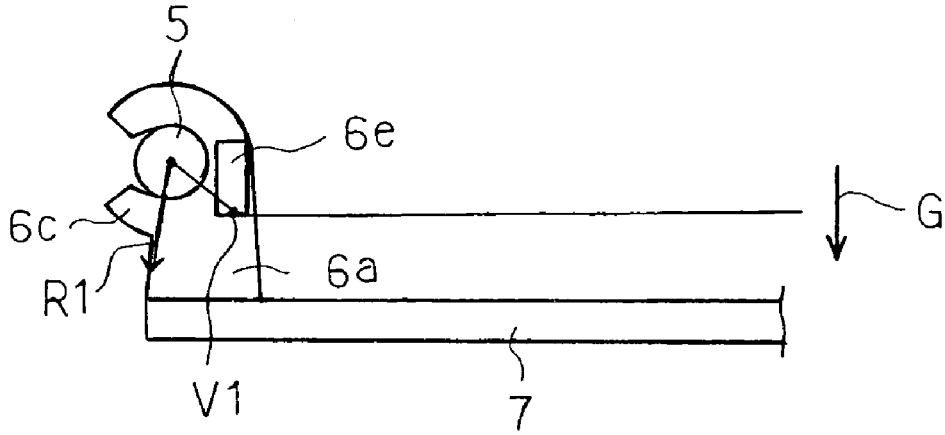
FIGS. 4A and 4B are partial side views of the paper tray for illustrating mechanical equilibrium of the paper tray in the horizontal position, with fulcrums on the under surface of a rib and on the edge of a paper support plate of the paper tray, respectively.
Figure 4B:
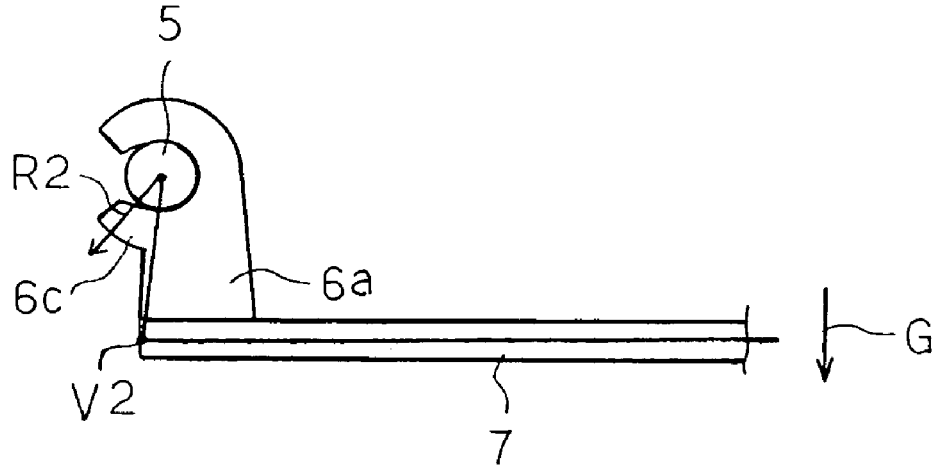
Figure 5:
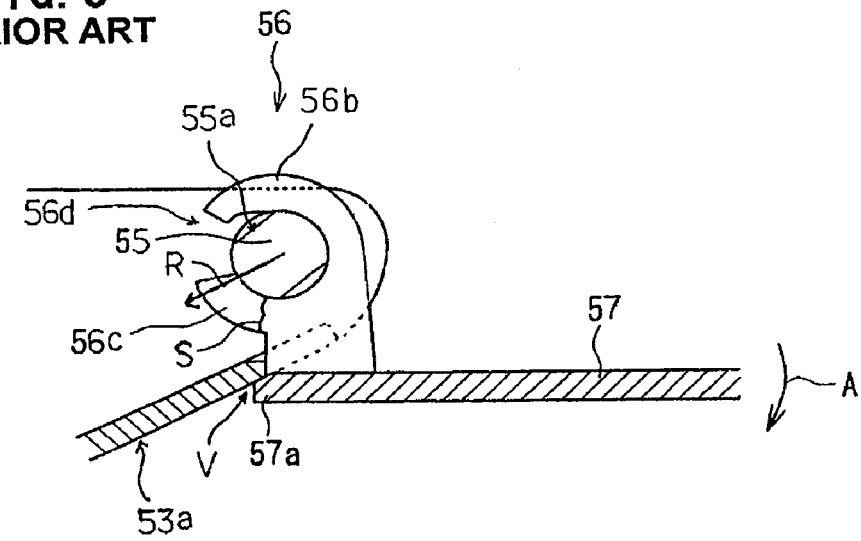
FIG. 5 PRIOR ART
FIG. 5 is a sectional side view of the hinge portion of the conventional printer paper tray.

Referring now to FIGS. 4A and 4B, description is made as to moments produced by impacts when the under surface 6*f* of the rib 6*e* provided on the C-shaped hook 6 comes in contact with the top surface 3*c* of the forward extending portion 3*b* of the housing wall and when the edge 14*a* of the paper support plate 7 comes in contact with the inclined surface of the housing wall 3*a*.

When the under surface 6*f* of the rib 6*e* on the C-shaped hook 6 comes in contact with the top surface 3*c* of the forward extending portion 3*b* of the housing wall (see FIG. 4A), a moment clockwise in FIG. 4A with a fulcrum V1 on the contact portion between the under surface 6*f* of the rib and the top surface 3*c* is produced by the gravity G of the paper support plate 7. As a result, a large reaction force R1 in a direction indicated by an arrow in FIG. 4A is applied to the C-shaped hook 6. However, since the fulcrum V1 is at a high location close to the protruding shaft 5, the reaction force R1 is directed substantially vertically downward to act mainly on the base portion 6*a* of the C-shaped hook 6 and not much on the lower arm 6*c*. More particularly, the moment produced about the fulcrum V1 does not produce such a force that causes the lower arm 6*c* to buckle from its base. As can be understood from the above description, in the case where the base portion 6*a* of the C-shaped hook 6 is formed wider and the lower arm 6*c* of the hook 6 is formed shorter, the fulcrum V1 can be located lower than that shown in FIG. 4A and thus the reaction force R1 can be directed somewhat diagonally forward rather than vertically downward as long as the direction of the reaction force R1 is toward the base portion 6*a* of the C-shaped hook 6. In other words, the location of the fulcrum V1 (the contact portion between the under surface 6*f* of the rib 6*e* and the top surface 3*c*) is determined so that the reaction force R1 is directed toward the base portion 6*a* of the C-shaped hook 6.

When the edge 14*a* of the paper support plate 7 comes in contact with the inclined surface of the housing wall 3*a* (see FIG. 4B), a moment clockwise in FIG. 4B with a fulcrum V2 on the contact portion between the edge 14*a* of the paper support plate 7 and the inclined surface of the housing wall 3*a* is produced by the gravity G of the paper support plate 7. This causes a large reaction force R2 in a direction indicated by an arrow in FIG. 4B to be applied to the C-shaped hook 6. The reaction force R2 is directed diagonally forward to directly act on the lower arm 6*c* because the fulcrum V2 is at a low location far from the protruding shaft 5.

As described above, according to the printer paper tray 1 of this embodiment, the rotation of the paper support plate 7 is limited at the two contact portions, i.e., the contact portion between the under surface 6*f* of the rib 6*e* and the top surface 3*c* (fulcrum V1) and the contact portion between the edge 14*a* of the paper support plate 7 and the housing wall 3*a*, whereby the impact force can be distributed (the distribution ratio of the impact force can be changed by adjusting the extension length of the forward extending portion 3*b* of the housing wall as described above). Further, the reaction force R1, which acts on the C-shaped hook 6 by the moment produced with the former contact portion as the fulcrum V1, is directed relatively vertically downward (toward the base portion 6*a* of the C-shaped hook 6). This can prevent a critical buckling stress on the lower arm 6*c*, so that the lower arm 6*c* can be protected from breakage.

Where the forward extending portion 3*b* of the housing wall is lengthened so that the fulcrum V1 is located substantially at the same level as the protruding shaft 5, the rotation of the paper support plate 7 to the horizontal position is limited mainly by the contact between the under surface 6*f* of the rib 6*e* and the top surface 3*c* (the fulcrum V1). In this case, the reaction force R1 applied to the lower arm 6*c* can be significantly decreased, so that the potential for breakage of the lower arm 6*c* can be minimized. However, at the same time, the configuration may cause a heavy stress on the under surface 6*f* of the rib 6*e* and on the top surface 3*c*. Therefore, in this case, it is preferable to incorporate a reinforcement structure. For example, it is preferable that the rib 6*e* on the C-shaped hook 6 and the extending portion 3*b* of the housing wall 3*a* are made relatively thick and a reinforcing rib is formed on the area of the extending portion 3*b* that comes in contact with the rib 6*e*.

The present invention has been described above using a presently preferred embodiment, but those skilled in the art will appreciate that various modifications are possible. Accordingly, all such modifications are intended to be included within the spirit and scope of the present invention.

This application is based on Japanese patent application 2005-77469 filed Mar. 17, 2005, the contents of which are hereby incorporated by reference.

What is claimed is:

1. A paper tray for a printer, comprising:

a paper support plate that is adapted to support either a sheet of paper to be fed through a paper inlet formed in a printer body or a sheet of paper ejected through a paper outlet formed in the printer body and that has a C-shaped hook having upper and lower arms to be open at one side of the hook; and a support frame that is formed on a housing of the printer body adjacent the paper inlet or the paper outlet and that has a protruding shaft and a housing wall, wherein the paper support plate is hinged to the support frame with the C-shaped hook engaged with the protruding shaft on the support frame so that the paper support plate can be rotated between a vertical position where the paper support plate is folded to be substantially parallel to a face of the printer body and a horizontal position where the paper support plate projects in a direction substantially perpendicular to the face of the printer body, wherein the housing wall has an extending portion extending forward beyond the protruding shaft, the extending portion having a top surface serving as a contact surface to contact the C-shaped hook, and the C-shaped hook has a contact surface to face the top surface of the extending portion at a position opposite to the open side, so that rotation of the paper support plate to the horizontal position is limited by the contact surface of the C-shaped hook coming in contact with the top surface of the extending portion.

2. The paper tray according to claim 1, wherein the C-shaped hook has a rib projecting from the position opposite to the open side, and the contact surface to face the top surface of the extending portion is provided on an under surface of the rib.

3. The paper tray according to claim 1, wherein the top surface of the extending portion is a substantially horizontal surface, and the C-shaped hook has a rib projecting sideward and having an under surface serving as the contact surface to face the top surface of the extending portion, so that the under surface of the rib coming in contact with the top surface of the extending portion limits the rotation of the paper support plate to the horizontal position and causes a reaction force acting, by gravity of the paper support plate, on the C-shaped hook with a fulcrum on the contact portion between the top surface of the extending portion and the under surface of the rib to be directed to a base portion of the C-shaped hook.

4. The paper tray according to claim 1, wherein the paper support plate is an assembly having a plurality of nested plates that can be extended and retracted.

* * * * *